US006247461B1

(12) United States Patent
Smith et al.

(10) Patent No.: US 6,247,461 B1
(45) Date of Patent: Jun. 19, 2001

(54) HIGH FLOW GAS FORCE BALANCED EGR VALVE

(75) Inventors: Craig Daniel Smith, Penfield; Paul Ludwig Gluchowski; Dwight Orman Palmer, both of Rochester; Mark A. Reeves, Hamlin, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/298,757

(22) Filed: Apr. 23, 1999

(51) Int. Cl.[7] ..... F02M 25/07

(52) U.S. Cl. ..... 123/568.2; 123/568.21; 251/129.07; 251/129.15

(58) Field of Search ..... 123/568.21, 568.17, 123/568.26, 568.4; 251/129.07, 129.15, 284, 367, 129.17; 137/315.03

(56) References Cited

U.S. PATENT DOCUMENTS

| | | | | |
|---|---|---|---|---|
| 2,014,968 | * | 9/1935 | Hughes . | |
| 2,717,003 | * | 9/1955 | Jay et al. . | |
| 5,443,241 | * | 8/1995 | Odaira et al. | 251/129.07 |
| 5,511,531 | * | 4/1996 | Cook et al. | 123/568.21 |
| 5,669,364 | * | 9/1997 | Everingham | 123/568.21 |
| 5,701,874 | * | 12/1997 | Sari et al. | 123/568.21 |
| 5,947,092 | * | 9/1999 | Hussey et al. | 123/568.26 |
| 6,006,732 | * | 12/1999 | Oleksiewicz | 123/568.2 |

FOREIGN PATENT DOCUMENTS

| | | | |
|---|---|---|---|
| 6-147025 | * | 5/1994 | (JP) . |
| 9-72250 | * | 3/1997 | (JP) . |
| 9-189364 | * | 7/1997 | (JP) . |

* cited by examiner

*Primary Examiner*—Andrew M. Dolinar
*Assistant Examiner*—Arnold Castro
(74) *Attorney, Agent, or Firm*—John VanOphem

(57) ABSTRACT

A relatively simple pressure balanced high flow exhaust gas recirculation (EGR) valve includes an actuator and a separately formed valve assembly retained to the actuator by a deformed lip. The valve body has dual seats controlled by axially spaced heads which are pressure balanced when closed and allow high gas flow when open. The valve body and the associated valve shaft, or portions thereof, are formed of materials having similar coefficients of thermal expansion so that the shaft and body experience similar thermal growth and good seating of the spaced valves is maintained regardless of gas temperature variations. Thickened portions at the valve seats comprise annular ends of a control portion which resist distortion of the seats. The valve body is configured for installation in a cylindrical bore or recess of an associated manifold or other gas passage defining member. Seal rings, preferably of elastomeric material, seal the controlled flow passages and maintain a small gap between the valve body walls and the passage defining member to minimize heat transfer and assist equalization of the body and valve shaft expansion rates. One or both of the valve heads may be attached to the shaft by a press and spin or crimping process to promote ease of assembly. The valve shaft may be supported by a single bushing carried in the mounting portion. A shaft seal in the bushing may include a lip responsive to gas pressures to vary the sealing force, for example, under turbocharged conditions.

7 Claims, 1 Drawing Sheet

HIGH FLOW GAS FORCE BALANCED EGR VALVE

TECHNICAL FIELD

This invention relates to high flow balanced pressure gas management valves and, in a particular embodiment, to high flow balanced pressure exhaust gas recirculation (EGR) valves for automotive vehicles.

BACKGROUND OF THE INVENTION

It is known in the art relating to vehicle engines to provide selective recirculation of engine exhaust gases into the intake manifold under certain operating conditions in order to maintain controlled exhaust emissions within desired limits. For controlling such exhaust gas recirculation, an EGR valve may be provided which includes a valve assembly mountable or connectable to associated intake and exhaust manifolds or systems of the engine to meter the flow of exhaust gas from the exhaust to the intake or to modulate the flow of EGR by manipulating the pressure differential.

The EGR valve may include a valve assembly operable to close or open a passage between the intake and exhaust manifolds. An actuator assembly may be mounted on or connected with the valve assembly and include a solenoid coil and an armature actuated by the coil to open or close the EGR valve, which is returned by a spring when the coil is deenergized. Pressure differentials between the intake and exhaust of naturally aspirated engines with manifold fuel injection require substantial solenoid energy to open the valve. With potential application to other engines, such as turbocharged engines, direct injection gasoline engines and diesel engines, where even larger gas flows may be required, reduction of solenoid energy for valve opening is desired to allow use of available solenoid actuators with valves for various engine applications.

SUMMARY OF THE INVENTION

The present invention provides relatively simple pressure balanced high flow exhaust gas recirculation (EGR) valves having various features. A particular embodiment includes a solenoid actuator and an attached valve assembly. The actuator includes a housing enclosing a coil actuated armature and having a lower mounting recess. The valve assembly includes a valve body having a mounting portion, a connecting portion and a control portion, which may, for example, be formed as a single machined casting, an extruded tube or be integrated as part of an engine manifold. A valve member includes a shaft reciprocably mounted in the body and carrying a pair of axially spaced valve heads engagable with spaced valve seats in the control portion of the body to control gas flow through control ports associated with the valve seats.

At least the control portion of the valve body and the portion of the shaft between the valve heads are preferably made from materials having similar coefficients of thermal expansion. Thereby, axial thermal expansion and contraction of these portions of the valve member and the valve body will be essentially equalized so that substantially equal seating contact of the spaced heads with their respective seats will be effectively maintained.

The valve body may be generally cylindrical with passage openings through the walls between the valve seats in the control portion and in the connecting portion to provide for a flow of gas when the valve is open. The valve seats define the control ports and comprise annular ends of the control portion which have thickened wall portions to resist distortion of the seats. The mounting portion also includes a thickened wall connected with a mounting flange that is received in the mounting recess of the actuator housing and is retained therein by deformed retaining means, such as a lip on the housing. The valve body is configured for installation in a cylindrical bore or recess of an associated manifold or other gas passage defining member. Seal rings of elastomeric or metallic material, are carried in annular grooves of the thickened wall portions and seal the controlled flow passages as well as maintaining a small gap between the valve body walls and the passage defining member to minimize heat transfer and assist equalization of the body and valve shaft expansion rates.

One or both of the valve heads may be attached to the shaft by a press and spin or crimping process to promote ease of assembly. The valve shaft may be supported by a single bushing carried in the mounting portion. A shaft seal in the bushing may include a lip that is responsive to gas pressures to vary the sealing force, for example, under turbocharged conditions.

These and other features and advantages of the invention will be more fully understood from the following description of certain specific embodiments of the invention taken together with the accompanying drawings.

DESCRIPTION OF THE PREFERRED EMBODIMENT

Figure 1:
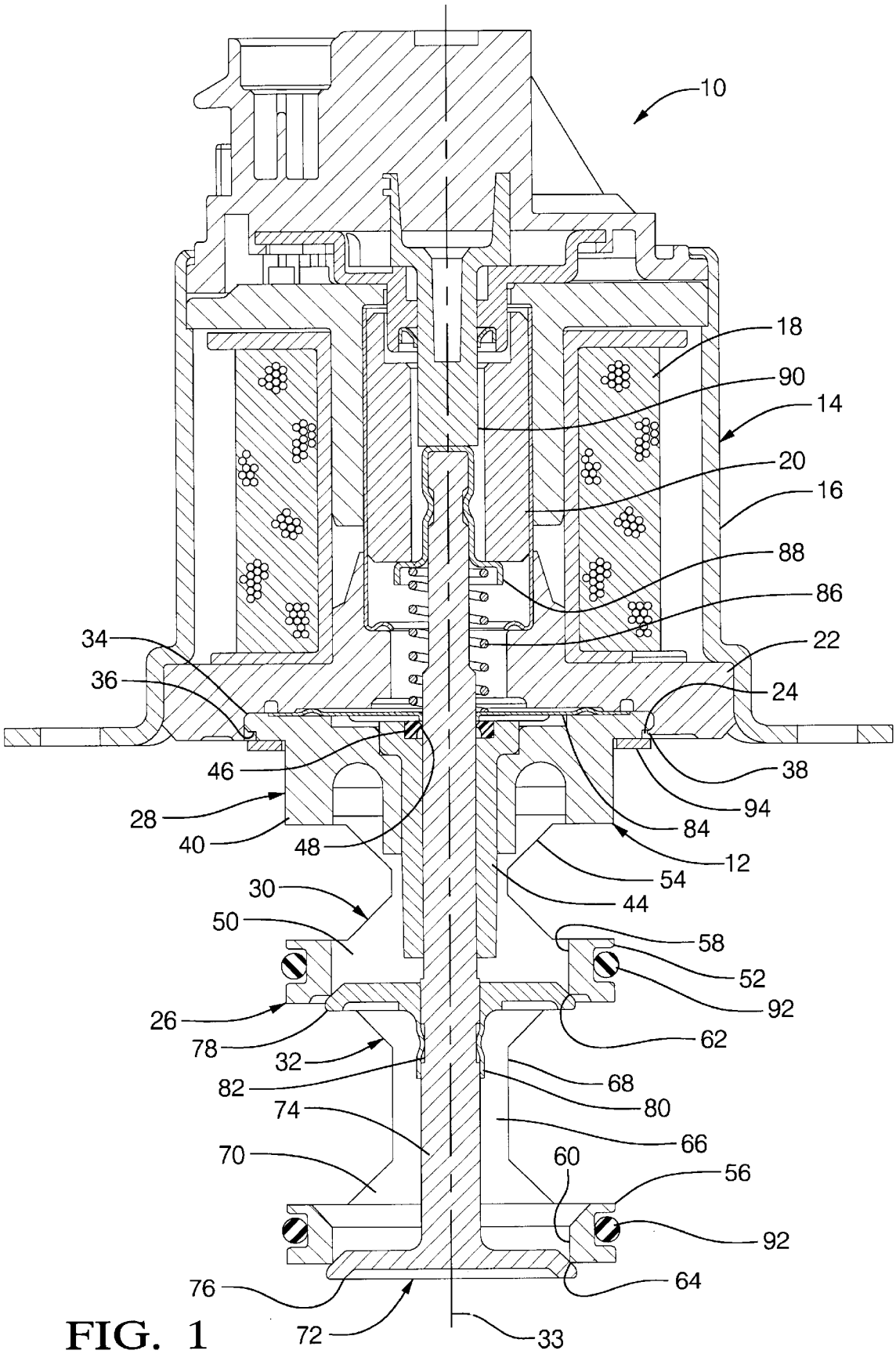
FIG. 1 is a transverse cross-sectional view of a high flow gas force balanced EGR valve formed according to the invention.

Referring now to the drawings in detail, numeral 10 generally indicates a high flow gas force balanced exhaust gas recirculation (EGR) valve embodying the features of the invention. EGR valve 10 is made up of two separately assembled components; namely, a valve assembly 12 and a solenoid actuator 14.

The solenoid actuator 14 is of generally conventional construction including a housing 16 containing a solenoid coil 18 acting upon a reciprocable armature 20. The lower portion of the housing is defined by a lower field pole 22 in which there is provided a counterbore like recess 24.

The valve assembly 12 includes a valve body 26 having a generally cylindrical form and including a mounting portion 28, a connecting portion 30 and a control portion 32 aligned on an axis 33. The mounting portion includes a mounting flange 34 which is sized to be received within the counterbore like recess 24 of the solenoid housing. The flange has an undercut lower edge 36 which is engaged by a depending lip 38 that extends from field pole 22 and is formed over or staked into engagement with the undercut edge 36 to retain the valve assembly 12 in the recess 24 of the solenoid housing 16.

Mounting portion 28 further includes a thickened wall 40 forming a downward cylindrical extension from the mounting flange 34. Inwardly of the mounting flange, mounting portion 28 carries a shaft bushing 44 having an upper edge centrally recessed to receive a shaft seal 46 having an inwardly and downwardly sloping conical lip 48.

Connecting portion 30 includes a pair of axially extending side elements 50 which extend on opposite sides from the thickened portion 40 of the control portion to a thickened annular upper end 52 of the control portion 32. The side elements comprise portions of a circumferential wall through which large flow passages or openings 54 extend to connect the interior of the connecting portion with exterior passages of a connecting manifold or other passage defining member, not shown.

Control portion 32 also includes an annular lower end 56 comprising a thickened wall portion that is axially aligned with and spaced from the annular upper end 52. These upper and lower ends internally define control ports 58, 60 having at their inner lower edges valve seats 62, 64 aligned on the axis 33. The ends 52, 56 are connected by a thinner cylindrical wall 66 interrupted by large cutouts or openings 68. The openings 68 communicate an internally defined control chamber 70 with other external passages, not shown, in an associated passage defining member.

Valve assembly 12 further includes a valve member 72 including a shaft 74 supported by the bushing 44 for reciprocating motion along the axis 33 on which the cylindrical valve body 26 and the reciprocable armature 20 are both aligned.

The illustrated embodiment, the lower end of the shaft 74 connects with an integrally formed valve head 76 which, in the closed position, engages the valve seat 64. Spaced upwardly from valve head 76 is a second valve head 78 which is integrally formed with a thin tubular hub 80 that is crimped or fixed to the shaft by a press and spin process which forces a portion of the tubular extension into an annular groove 82 extending around the shaft. Valve head 78 is positioned to engage the upper valve seat 62 when the lower head 76 engages the valve seat 64 so that both control ports 58, 60 are closed at the same time.

Valve shaft 74 extends upward through the connecting and mounting portions and the bushing 44 where the shaft is engaged by the lip 48 of the shaft seal 46. This lip is responsive to pressure variations of gas within the valve housing below so as to increase the sealing pressure of the lip as the gas pressure is increased.

A thin separator or gas shield 84 extends across the upper surface of the mounting flange 34, engaging the inner surface of the recess 24 and acting as a seal separating the gas passages of the valve body from the internal portions of the actuator housing above. Vents are provided above and below the gas shield to avoid any significant passage of gases between the actuator and the valve housing. A biasing spring 86 seated on the gas shield 84 extends upward to engage a spring seat 88 that bears against the solenoid armature 20. The spring seat includes an integral "top hat" portion that is crimped or staked to the valve shaft 74. The "top hat" portion extends over an upper end of the shaft 74 to engage a linear position sensor 90 which follows the motion of the shaft in order to indicate to a control system the position of the EGR valve.

O-ring seals 92 are provided in grooves around the thickened wall portions defining the control ports 58, 60. These elastomeric seals allow linear expansion and contraction of the valve body within its associated bore while maintaining sealing separation of the associated internal gas passages within the valve body and the associated external passage defining member. A flat seal 94 is provided under the mounting flange 34 of the valve body mounting portion. Other suitable forms of seals could be substituted for these seals if desired.

In use, valve 10 is mounted upon a manifold, or other intake and exhaust system passage defining member of an internal combustion engine. The solenoid housing 16 is mounted upon an outer surface of the manifold or other member. The valve body cylindrical portion, other than the flange 34 extends into a bored recess of the associated manifold or other member in which exhaust and intake system passages are provided. The openings 68 in the control portion 30 connect the control chamber 70 with one set of internal intake or exhaust passages. The openings 54 in the connecting portion 30 communicate the upper surface of valve head 78 and the interior of the connecting portion with an external intake or exhaust passage, not shown, of the associated manifold.

That same external passage or one connected therewith is also communicated with the lower surface of valve head 76 of the valve member 72. Thus, exhaust or intake pressures of that external passage are communicated to the upper surface of the upper valve head and the lower surface of the lower valve head, thereby balancing the forces exerted by this passage system on the valve member. In like manner, pressures in the other intake or exhaust passage communicating through openings 68 with the control chamber 70 are exerted upon the lower surface of the upper valve head and the upper surface of the lower valve head, balancing the forces of gas pressure in this passage which act upon the valve member 72. The valve heads are relatively large so that a high volume of gas flow is permitted between the two sets of external gas passages when the valve is open, but when the valve is closed, the pressures exerted by the gas passages are balanced so that the force required to open the dual headed valve is not significantly affected by gas pressures.

In operation, energizing of the coil 18 causes downward motion of the armature 20 against the bias of spring 86, forcing the shaft 74 and valve member 72 downward. This unseats both valve heads from their respective valve seats, allowing gas to flow between the control chamber 70 and the external gas passage above the upper valve head and below the lower valve head.

The materials of the valve body and the associated valve member, or at least the portion of the shaft between the valve heads and the portion of the valve body between the valve seats are made with materials having similar coefficients of thermal expansion. This allows both the valve member and the valve body to expand and contract at essentially the same rate so that the dual valve heads will always maintain good contact with their respective valve seats when the valve is seated, irrespective of the varying temperatures of gas flowing through the valve. This feature is aided by use of the elastomeric or metallic seals which allow free expansion of the valve body and also tend to hold the body away from the associated passage defining member bore by a small clearance so that heat transferred to the associated member does not adversely affect the relative temperatures of the valve body and valve member.

While the invention has been described by reference to a preferred embodiment, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A dual port EGR valve for controlling exhaust gas flow to an induction system of an internal combustion engine, said valve comprising:

a valve body including a control portion, said control portion having annular ends forming spaced control ports including valve seats aligned on an axis, and axially extending side elements connecting the annular ends and defining a control chamber between the valve seats, the side elements also defining gas passage openings between the valve seats and communicating with the control chamber;

a valve member including a shaft and first and second axially spaced heads mounted on the shaft, said shaft centered on said axis for reciprocating motion thereon and said spaced heads being engagable with said valve seats for simultaneously closing said control ports;

wherein said control portion and at least a portion of said shaft between said valve heads being made of materials having similar coefficients of thermal expansion so that axial expansion and contraction of the shaft and the control portion between the valve seats due to varying gas temperatures will be essentially equalized and substantially equal seating contact of the spaced heads with their respective seats will be effectively maintained; and wherein said annular ends carry seals rings for engagement with a cooperating recess of a gas passage defining member mounting the EGR valve to seal the peripheries of the annular ends and hold the control portion away from direct contact with the passage defining member to minimize heat transfer therebetween.

2. A dual port EGR valve as in claim 1 wherein said valve body further includes a mounting portion and a connecting portion between the control and mounting portions and open to one of said valve heads, the connecting portion including side openings for communicating with external passage means open to the other of said valve heads, whereby said valve member is pressure balanced, when the valve heads are seated, by internal pressure in the control chamber acting on inner sides of the valve heads and external pressure in the connecting portion and external passage means acting on outer sides of the valve heads.

3. A dual port EGR valve as in claim 2 wherein said mounting portion includes a flange adapted to be mounted to an associated actuator by deforming of a portion of the actuator against the flange.

4. A dual port EGR valve as in claim 3 wherein said mounting portion engages an external seal ring for sealing against leakage from the external passage means.

5. A dual port EGR valve as in claim 3 wherein said mounting portion carries a bushing supporting said shaft on said axis with the spaced heads carried in overhung fashion for alignment with their respective ports.

6. A dual port EGR valve as in claim 5 including a shaft seal carried by said bushing and having a pressure actuated lip engaging the shaft and responsive to pressure in the connecting portion to vary the sealing force in response to gas pressure.

7. A dual port EGR valve as in claim 3 and including an actuator having a housing carrying a movable member, said housing including a recess receiving said flange of the valve body mounting portion, and deformed retaining means holding the valve body in assembly with the housing, said valve shaft being in operative engagement with said movable member for selectively actuating the valve member.

* * * * *